United States Patent [19]

Cloudy

[11] 4,078,398

[45] Mar. 14, 1978

[54] FOOD FREEZING TUNNEL WITH IMPROVED FREEZING AIR FLOW APPARATUS

[75] Inventor: Westley Ray Cloudy, Edmonds, Wash.

[73] Assignee: Cloudy & Britton, Inc., Edmonds, Wash.

[21] Appl. No.: 729,268

[22] Filed: Oct. 4, 1976

[51] Int. Cl.[2] ..... F25D 25/04

[52] U.S. Cl. ..... 62/380; 415/185; 415/213 B

[58] Field of Search ..... 62/63, 266, 380; 415/182, 185, 213 B

[56] References Cited

U.S. PATENT DOCUMENTS

| | | | |
|---|---|---|---|
| 2,527,542 | 10/1950 | Gilson | 62/380 |
| 3,122,897 | 3/1964 | Overbye | 62/380 |
| 3,938,350 | 2/1976 | Martin et al. | 62/380 |

*Primary Examiner*—Ronald C. Capossela
*Attorney, Agent, or Firm*—Roy E. Mattern, Jr.; David H. Deits; Kenneth S. Kessler

[57] ABSTRACT

In an improved food freezing tunnel, an improved freezing air flow apparatus, more uniformly distributes upwardly flowing freezing air through a horizontally traveling porous food conveyor, thereby more effectively freezing the conveyed food pieces. The improved freezing air flow apparatus utilizes a centrifugal fan wheel, without a surrounding volute or housing, mounted with its rotational axis arranged vertically. It is dependingly mounted from a fan motor, in turn centrally supported, on horizontal frame, within the fan chamber located over an open bottom lower air souce chamber of the freezing tunnel. Returning air, after passing from the fan chamber up through the freezing coil chamber, and beyond up through the porous conveyor belts of the freezing chamber, is drawn down within the overall freezing tunnel building alongside each side of the freezing tunnel, to be again drawn upwardly through the open bottom air source chamber and then back up into the fan wheel and fan chamber for recirculation. During this recirculation, upon leaving the unhoused centrifugal fan wheel, the cooling air is first discharged tangentially throughout 360° in an overall horizontal direction. Thereafter the cooling air is deflected directly upwardly, by using inclined inside circular sides to guide the cooling air uniformly throughout the entire cross-sectional areas of the freezing tunnel inclusive of the entire volume of the freezing coil chamber, located directly over the fan chamber, and also the moving porous food conveyor volume located over the freezing coil chamber to more effectively and uniformly freeze the conveyed food products.

10 Claims, 2 Drawing Figures

FOOD FREEZING TUNNEL WITH IMPROVED FREEZING AIR FLOW APPARATUS

BACKGROUND OF THE INVENTION

Food freezing tunnels have been in use for many years. In most tunnels food to be frozen is conveyed through the tunnel on a porous conveyor belt. Freezing air has been directed around the top and bottom of the belt by a side mounted fan, as illustrated in Frank W. Knowles' U.S. Pat. No. 2,385,140 disclosing his process of freezing food. Also the freezing air has been directed through the porous conveyor belt, as illustrated in various patents, such as Walter E. Hirtensteiner's U.S. Pat. No. 3,376,710 disclosing his food freezing apparatus having an overhead fan, or as illustrated in Willis S. McLeese's U.S. Pat. No. 3,425,237 disclosing his vibrating food freezer, having a lower fan, or as illustrated in another U.S. Pat. No. 2,300,229, of Frank W. Knowles, describing the freezing of peas having a side mounted fan.

In Mr. Hirtensteiner's U.S. Pat. No. 3,376,710, and in Mr. McLeese's U.S. Pat. No. 3,425,237, the air, discharging from the fans, is essentially moving directly toward the porous conveyor belt moving the food products through the freezing tunnel. Although less width is possible in arranging such freezing tunnels, in contrast to the freezing tunnels of Frank W. Knowles, the strong but non-uniform discharge of the cooling air directly from the fans has led to the irregular freezing of the food products being conveyed. In an attempt to gain a more uniform distribution of the cooling air, other persons, like Frank W. Knowles in his U.S. Pat. Nos. 2,300,229 and 2,385,140, have increased the width of their freezing tunnels to place the fan and its chamber off to one side, and then redirect the freezing air through the adjacent chamber in which the porous conveyor belt is carrying the foods being frozen. In other freezing tunnels currently in operation, fans with their volutes and shrouds are angularly mounted to one side of freezing tunnels, thereby requiring wider buildings or interior building spaces in an attempt to obtain more uniform freezing air distribution.

SUMMARY OF THE INVENTION

Improved uniform freezing air distribution is now obtained in passing such air upwardly through a porous conveyor belt to thereby more uniformly freeze the conveyed food products, by utilizing an unhoused centrifugal fan wheel, without a volute, or shroud. The fan wheel is mounted with its axis vertically positioned so it discharges air radially in horizontal directions to be subsequently redirected upwardly, by surrounding sloping sides of the air chamber and on upwardly through the freezing coil chamber and the overhead conveyor chamber, which chambers are all vertically aligned to thereby create an improved food freezing tunnel, which occupys a minimum of floor space. During defrosting, the water in dropping down from the freezing coils is deflected over a centrally mounted fan motor and deflected clear of the fan wheel for collection on an annular base supporting the air intake structure from which the water is easily drained.

DESCRIPTION OF THE PREFERRED EMBODIMENT

General Arrangement

Figure 1:
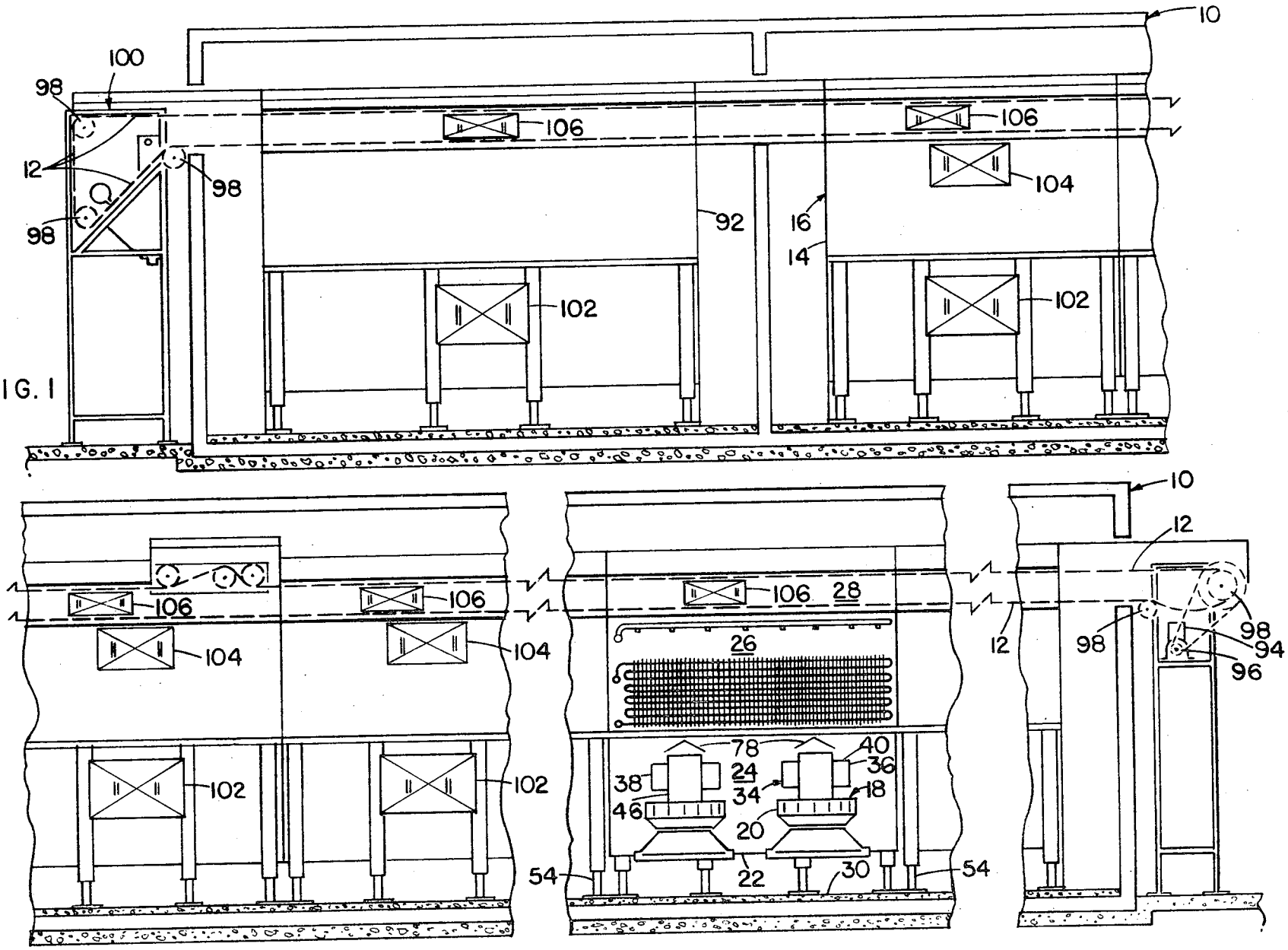
FIG. 1 is a longitudinal cross sectional view taken just inside the wall of a food freezing tunnel building, with broken lines serving to indicate the food freezing tunnel and building are much longer with several repeating units of unhoused centrifugal fan wheels and freezing coils, with portions of one side of such a unit being broken away to illustrate the interior longitudinal arrangement of the unhoused centrifugal fan wheels, fan motors, fan motor supports, fan intake, freezing coils, porous conveyors for food products, and defrosting water deflector and collector structures.

Precooked food products, such as french fried potatoes are loaded adjacent to sub building like enclosure 10, on a porous food product conveyor 12, which operationally extends throughout several end to end freezing units 14, shown in part in FIG. 1, of the overall improved freezing tunnel 16. The improved freezing air flow apparatus 18 of this tunnel 16 centers on the operation of an unhoused centrifugal fan 20, shown in FIG. 2 mounted with its rotational axis vertically positioned in the cross sectional center of one half of one freezing unit 14. The lower air inlet chamber 22, the fan or air chamber 24, the freezing coil chamber 26, and the porous conveyor belt chamber 28, are respectively located one above the other in an overall in line assembly occupying a comparatively minimum floor area 30.

Arrangement of the Unhoused Centrifugal Fan Wheel

Figure 2:
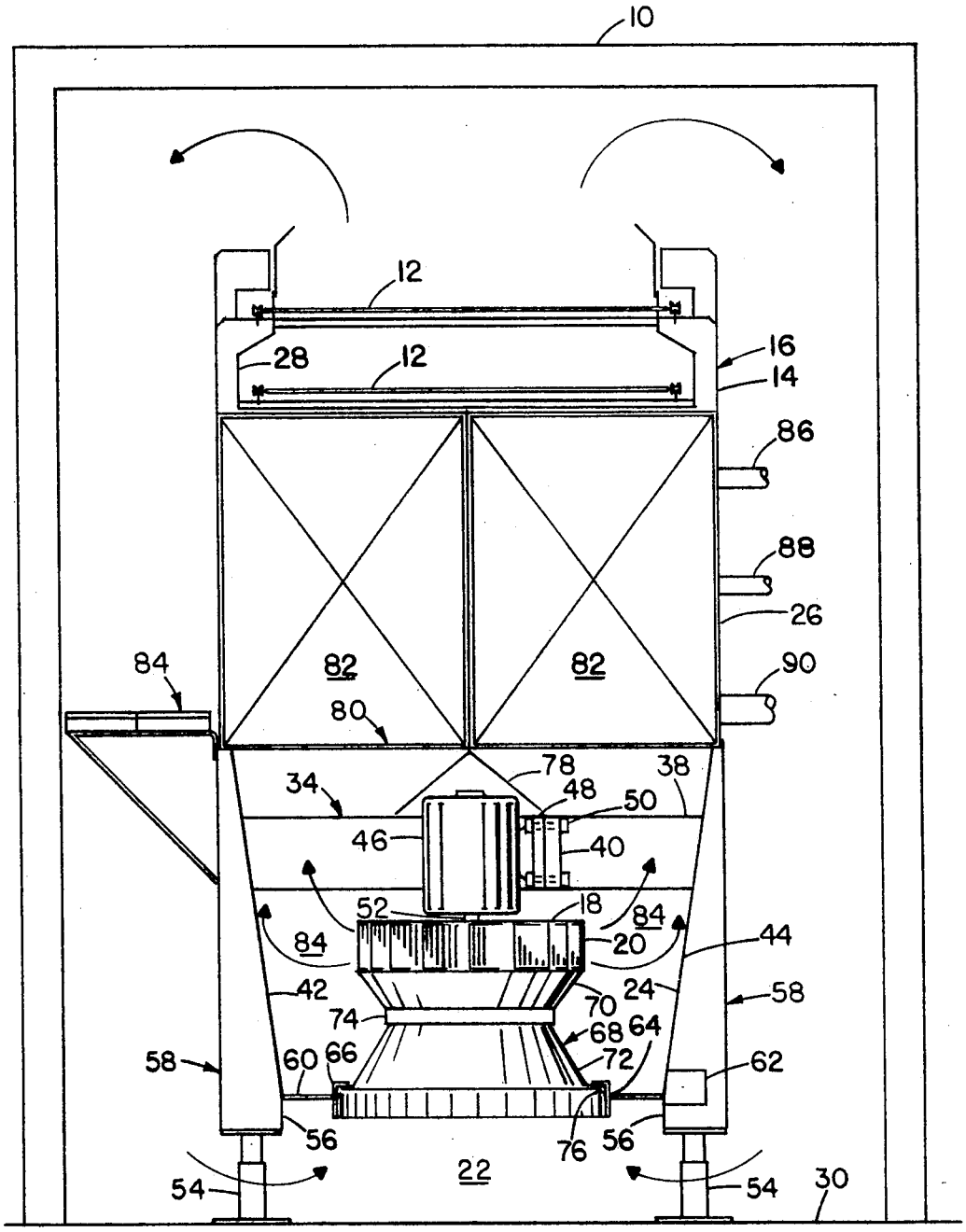
FIG. 2 is a transverse cross sectional view taken adjacent the location of an unhoused centrifugal fan wheel indicating the reduced floor space in line arrangement of the air intake, fan wheel, air chamber, freezing coil chamber, and porous conveyor belt, with motion arrows showing the horizontal discharge of air from the fan wheel, the vertical deflection of this air by sloping sides of the air chamber, the subsequent uniformity of the air flow upwardly through the freezing coil chamber and beyond upwardly through the porous conveyor belt, which carries the food products to be frozen, and also illustrating how the air is recirculated adjacent the interior walls of the narrower building containing the vertical in line cross sectional arrangement of this improved food freezing tunnel with its improved recirculation freezing air flow, and in addition illustrating how the water is deflected, collected, and drained during defrosting.

In an air chamber 24, which may also be referred to as a fan chamber 24, in each end to end freezing unit 14, two unhoused centrifugal fan wheels 20 are mounted with their rotational axes being arranged vertically, as illustrated in both FIGS. 1 and 2. A horizontal three piece open supporting frame 34, having two spaced transverse members 36, 38 and one longitudinal member 40, extending between them, are secured as a frame 34, by attachment of all of the ends of the transverse members 36 and 38 to the sloping interior side walls 42, 44 of the air chamber 24. Then a fan motor 46 is secured at its base 48 by fastener assemblies 50 to the longitudinal member 40 of frame 34. A depending shaft 52 of the fan motor 46 is attached to the shaft, not shown, of the unhoused centrifugal fan wheel 20. Depending on the overhaul requirements of other embodiments and fan specifications, one, two, three or more fans may be installed.

Combined Intake Air Duct and Defrosting Water Collector and Drain Sub Assembly

Multiple leg supports 54 are used throughout the length of the freezing tunnel 16 at spaced intervals along both sides. Air returning from above along the exteriors of the freezing tunnel 16 and inside the walls of the sub building enclosure 10 is drawn between these multiple leg supports 54 and then upwardly through a lower inlet chamber 22 with an open bottom and limited inside portions 56 of the overall sides 58 of the freezing tunnel 16.

The top 60 of the lower inlet chamber is a nearly horizontal plate 60 positioned on a draining slope to one side leading to a defrosting water drain 62. Two holes 64 are provided in each plate 60 in each freezing unit 14 to accommodate two mounting rings 66, which are secured in a level position.

Inserted from below, up through each mounting ring 66, is a two piece intake air duct subassembly 68. The upper conical portion 70 is secured for rotation with the unhoused centrifugal fan wheel 20, and the lower conical portion 72, with a spaced overlapping flange 74, is secured at spaced intervals to the mounting ring 66 with fastener assemblies 76. For inspection, cleaning, and possible repair, or replacement, all these members are conveniently disassembled and withdrawn from the air or fan chamber 24 down into the lower inlet chamber 22, and then completely clear of the freezing tunnel 16. Above the fan motor 46, a defrosting water conical shield 78 is secured to the supporting structure of the freezing coils 82.

When defrosting occurs, the water is deflected by this shield 78 and eventually collected at the top 60 of the lower inlet chamber and directed through the drain 62. The exterior of two piece intake air duct 68 in conjunction with the sloping interior walls 42, 44 of the air or fan chamber 24 completes the defrosting water collection volume 84. The exterior walls 42, 44 are sloped so the defrost water effectively washes their surfaces.

Recirculating Uniform Air Flow Involving Comparatively Limited Floor Space With Fan Wheels Operating Safely Within the Freezing Tunnel The returning air comes down inside the sub building enclosure 10 and outside of the freezing tunnel 16 along both sides 58. Then the returning air is drawn between the leg supports 54 and back up into the lower air inlet chamber 22. Thereafter it enters the two piece intake air duct 68. The unhoused centrifugal fan wheel 20, well positioned inside the freezing tunnel 16, draws the returning air vertically through this intake air duct 68 and thereafter discharges the air in a horizontal direction. This pressurized high velocity air, however, soon deflects upwardly as the air flow is so guided by the sloping interior walls 42, 44 of the fan or air chamber 24. The air flow volume expands and passes upwardly through the fan supporting frame 34 and through the open frame 80 supporting the freezing coils 82. The air flow continues on through these freezing coils 82 with its flow volume continuing to be more uniformly distributed throughout the comparatively limited cross section of the overall freezing tunnel 16. Complete uniformity is reached as the freezing air passes up through the returning porous conveyor belt 12 and so remains as the freezing air passes on through the porous conveyor belt 12 carrying the food products (not shown) being frozen. Upon leaving the porous conveyor belt chamber 28, the freezing air soon becomes the return air to again pass downwardly outside and alongside the sides 58 of the freezing tunnel 16, which together with the sub building enclosure 10 occupy a comparatively limited floor area.

Other Components of the Freezing Tunnel

A porous catwalk sub assembly 84 is provided for convenience of maintenance personnel. There are defrosting liquid lines 86, freezing liquid lines 88 and return lines 90 used in conjunction with freezing coils 82, as illustrated in FIG. 2. As shown in FIG. 1, before the commencement of freezing units 14 of the freezing tunnel 16, there is a cooling and dehumidifying unit 92. The porous conveyor belt 12 has a driving motor 94 and driving pulley 96 and thereafter many guiding pulleys 98. Moreover, there is a porous conveyor belt washer and dryer subassembly 100. Throughout the freezing tunnel large inspection removable panels 102, medium inspection removable panels 104 and small inspection removable panels 106 are selectively located to aid maintenance personnel in their observation, maintenance, repair, and replacement assignments undertaken to keep this improved food freezing tunnel, with its improved freezing air flow apparatus, in its top operating performance range, wherein food products are uniformly and efficiently frozen.

I claim:

1. A food freezing building structure and inside food freezing tunnel occupying a limited floor area in utilizing efficiently a uniform flow of freezing air moved by an unhoused centrifugal fan wheel mounted with its axis vertically positioned within the freezing tunnel, comprising:

(a) a food freezing building structure;

(b) a food freezing tunnel mounted within the food freezing building structure creating return downwardly flowing air passageways between the respective walls of the food freezing building structure and food freezing tunnel;

(c) a lower inlet air chamber in the bottom of the food freezing tunnel to receive and to turn the returning air;

(d) a fan chamber in the food freezing tunnel to receive the returning upwardly flowing air from the lower inlet air chamber;

(e) an unhoused centrifugal fan wheel and its fan motor mounted centrally in the fan chamber with its axis vertically positioned to receive the return air from the lower center of the fan chamber and discharge the air in a horizontal direction in the fan chamber;

(f) sloping interior sides of the fan chamber to redirect, into a vertical flow again, the air being horizontally discharged by the unhoused centrifugal fan wheel;

(g) a freezing coil chamber and freezing coils mounted therein positioned above the fan chamber within the freezing tunnel to receive, and drop the temperature of the circulating air creating a uniform freezing air flow passing upwardly; and (h) a porous conveyor belt chamber and porous conveyor belt and driving assembly within the freezing tunnel positioned above the freezing coil chamber to move food products through the uniform upwardly flow of the freezing air flow and to exit the freezing air flow for its return downwardly alongside the outside of the freezing tunnel.

2. A food freezing building structure and inside food freezing tunnel, as claimed in claim 1, wherein, in the fan chamber an intake air duct is centrally installed and a surrounding top of the lower inlet air chamber is installed adjacent the intake air duct to create a defrosting water collection volume.

3. A food freezing building structure and inside food freezing tunnel, as claimed in claim 2, wherein a drain is provided adjacent the surrounding top of the lower inlet air chamber to direct the defrosting water out of the freezing tunnel.

4. A food freezing building structure and inside food freezing tunnel, as claimed in claim 2, wherein a ring is installed in the surrounding top of the lower inlet air chamber and fastener assemblies are used to secure the intake air duct to this ring whereby the intake air duct may be removed for inspections and repair of all components located in the fan chamber.

5. A food freezing building structure and inside food freezing tunnel, as claimed in claim 2, wherein the intake air duct has two conical portions one to rotate with the unhoused centrifugal fan and one to remain with the surrounding top of the lower inlet air chamber.

6. A food freezing building structure and inside food freezing tunnel, as claimed in claim 1, wherein a drain shield is mounted within the freezing tunnel over the fan motor to deflect the defrosting water.

7. A food freezing tunnel for installation inside a building structure utilizing a comparatively limited floor area in utilizing efficiently a uniform flow of freezing air moved by an unhoused centrifugal fan wheel mounted with its axis vertically positioned within the freezing tunnel, comprising:

(a) a food freezing tunnel mounted within a building structure to draw air in below the food freezing tunnel and to expel air above the food freezing tunnel thereby using interior spaces of the building structure for return air flows;

(b) a lower inlet air chamber in the bottom of the food freezing tunnel to receive and to turn the returning air;

(c) a fan chamber in the food freezing tunnel to receive the returning upwardly flowing air from the lower inlet air chamber;

(d) an unhoused centrifugal fan wheel and its fan motor mounted centrally in the fan chamber with its axis vertically positioned to receive the return air from the lower center of the fan chamber and discharge the air in a horizontal direction in the fan chamber;

(e) sloping interior sides of the fan chamber to redirect, into a vertical flow again, the air being horizontally discharged by the unhoused centrifugal fan wheel;

(f) a freezing coil chamber and freezing coils mounted therein positioned above the fan chamber within the freezing tunnel to receive, and drop the temperature of the circulating air creating a uniform freezing air flow passing upwardly; and (g) a porous conveyor belt chamber and porous conveyor belt and driving assembly within the freezing tunnel positioned above the freezing coil chamber to move food products through the uniform upwardly flow of the freezing air flow and to exit the freezing air flow for its return downwardly alongside the outside of the freezing tunnel.

8. A food freezing tunnel for installation inside a building structure utilizing a comparatively limited floor area in utilizing efficiently a uniform flow of freezing air moved by an unhoused centrifugal fan wheel mounted with its axis vertically positioned within the freezing tunnel, comprising:

(a) a food freezing tunnel mounted within a building structure to draw air in below the food freezing tunnel and to expel air above the food freezing tunnel thereby using interior spaces of the building structure for return air flows;

(b) a fan chamber in the food freezing tunnel to receive the returning air and direct it upwardly;

(c) an unhoused centrifugal fan wheel and its fan motor mounted centrally in the fan chamber with its axis vertically positioned to receive the return air from the lower center of the fan chamber and discharge the air in a horizontal direction in the fan chamber;

(d) sloping interior sides of the fan chamber to redirect, into a vertical flow again, the air being horizontally discharged by the unhoused centrifugal fan wheel;

(e) a freezing coil chamber and freezing coils mounted therein positioned above the fan chamber within the freezing tunnel to receive, and drop the temperature of the circulating air creating a uniform freezing air flow passing upwardly; and (f) a porous conveyor belt chamber and porous conveyor belt and driving assembly within the freezing tunnel positioned above the freezing coil chamber to move food products through the uniform upwardly flow of the freezing air flow and to exit the freezing air flow for its return downwardly alongside the outside of the freezing tunnel.

9. For installation in a food freezing tunnel, a fan chamber sub assembly, comprising:

(a) a fan chamber structure to be dependingly supported adjacent to and in line with a freezing coil chamber of a food freezing tunnel;

(b) a fan motor centrally installed in the fan chamber structure having a depending driven shaft;

(c) an unhoused centrifugal fan wheel secured to the depending driven shaft of the fan motor; and (d) sloping interior sides of the fan chamber structure to receive the horizontally discharging air from the unhoused centrifugal fan wheel and to redirect this discharging air upwardly for entry into a freezing coil chamber.

10. For installation in a food freezing tunnel, a fan chamber subassembly, as claimed in claim 9, comprising in addition, a two piece intake air duct, one piece rotating with the fan wheel and one piece being stationary with the fan chamber, to guide the upflowing air into the fan wheel, and during defrosting to guide the water into a collecting volume.

* * * * *